United States Patent [19]

Yum et al.

[11] 4,450,418

[45] May 22, 1984

[54] STRIPLINE-TYPE POWER DIVIDER/COMBINER WITH INTEGRAL RESISTOR AND METHOD OF MAKING THE SAME

[75] Inventors: Lawrence H. Yum, Los Angeles; Fu-Chuan Chen, Culver City, both of Calif.

[73] Assignee: Hughes Aircraft Company, El Segundo, Calif.

[21] Appl. No.: 335,130

[22] Filed: Dec. 28, 1981

[51] Int. Cl.[3] ..... H01P 5/12

[52] U.S. Cl. ..... 333/128; 333/246; 338/314; 338/325; 338/324

[58] Field of Search ..... 333/128, 22 R, 81 A; 338/314, 324, 325

[56] References Cited

U.S. PATENT DOCUMENTS

| | | | |
|---|---|---|---|
| 3,585,533 | 6/1971 | Denhard | 333/22 R |
| 3,634,789 | 1/1972 | Stuckert . | |
| 3,701,056 | 10/1972 | Ozawa et al. . | |
| 3,778,735 | 12/1973 | Steenmetser . | |
| 3,886,498 | 5/1975 | Mosko et al. | 333/128 |
| 3,916,354 | 10/1975 | Tomimura . | |
| 3,968,458 | 7/1976 | McGowan . | |
| 4,090,155 | 5/1978 | Tateno et al. . | |
| 4,129,839 | 12/1978 | Galani et al. | 333/128 |
| 4,189,691 | 2/1980 | McDonough . | |
| 4,310,812 | 1/1982 | DeBloois | 333/81 A |

*Primary Examiner*—Paul L. Gensler

*Attorney, Agent, or Firm*—Gerald B. Rosenberg; David W. Collins; A. W. Karambelas

[57] ABSTRACT

A high frequency stripline-type power divider/combiner comprising a patterned metal layer having an input and two output strips, a dielectric substrate, and a resistive material layer interposed between the metal layer and substrate. A portion of the resistive material layer defines a resistive bridge that extends between and resistively interconnects the output strips, thereby acting as a resistive load for the cancellation of reflected power output signals. The patterned metal layer and resistive bridge are concurrently defined by standard photolithographic and etching techniques, thereby allowing the simple and accurate fabrication of an integral power divider/combiner.

11 Claims, 3 Drawing Figures

STRIPLINE-TYPE POWER DIVIDER/COMBINER WITH INTEGRAL RESISTOR AND METHOD OF MAKING THE SAME

BACKGROUND OF THE INVENTION

The present invention relates to high frequency power dividers and power combiners and, more specifically, to high frequency stripline and airstripline power dividers/combiners.

Stripline-type power dividers and power combiners are generally well known in the art of high frequency power manipulation (frequency range of approximately 2–18 GHz). Further, it is generally well-known in the art that such power dividers are structurally identical to power combiners. A power divider is typically formed as a patterned metal layer having an input power strip and two power output strips. The power combiner differs only in that the inputs and outputs are reversed so as to have two inputs and a single output. Thus, a power divider/combiner structure can, and will hereinafter, be generically referred to as a power divider. The particular design of the patterned metal layer of stripline-type power dividers is a product of well-known equations solved for conductors operating substantially in the TEM mode. The metal layer is usually supported by a dielectric substrate and further surrounded by a conductive ground plane.

The airstripline configuration power divider is similar to the other stripline-type power dividers in that it uses a patterned metal layer for the input power signal's conductive path. However, it differs in that a second metal layer, patterned as a mirror image of the first, is provided on a parallel opposing surface of the dielectric substrate and positioned so as to have a topological one-to-one correspondence. The ends of the respective input and output strips are then conductively connected to form a single, operative power divider having parallel conductive paths.

A well-known problem associated with the practical operation of power dividers is the need to effectively isolate each of the power inputs from any portion of the power output signal reflected back into the other power output of the divider. Reflection of a portion or all of the power output signal back into its respective power output may be caused by a mismatch in impedance or open circuit condition between the power output and its corresponding load device.

The necessary isolation is typically provided by connecting a resistive load between the output strips of the power divider. Given that the divider has a center operating frequency of:

$$f_c = \frac{C}{\sqrt{\epsilon}\,\lambda},$$

where C is the speed of light in free space, $\epsilon$ is the relative dielectric constant, and $\lambda$ is the wavelength of the signal ($f_C$ thus being proportional to $1/\lambda$), the load resistance is connected at points a multiple of $\lambda/4$ distant from the junction of the power input strip and the power output strips. This provides a portion of the reflected power output signal with a conductive path between the power outputs that is approximately a distance of $\lambda/2$ shorter than the path traversed by the remainder of the reflected power output signal. This produces an approximately 180° phase difference between the two portions of the reflected power output signal that, consequently, results in the effective cancellation of the reflected power output signal.

A particular problem in the efficient fabrication of high frequency power dividers is the need to physically place the resistive load between the output strips of the dividers. The resistive load is usually either a standard high frequency resistor whose leads have been soldered to the respective output strips or a discrete, chip-like, thin-film resistor which has been placed in a depression formed in the substrate and soldered between the two output strips. In either case, the requirement that the load resistance be physically placed and soldered into position comprises the simplicity and accuracy of the fabrication process which results in increased cost and decreased device yield.

SUMMARY OF THE INVENTION

The general purpose of the present invention, therefore, is to provide an efficient, high frequency power divider/combiner having a structure that can be easily and accurately fabricated.

To provide this, the present invention calls for a dielectric substrate, a metal layer patterned to form a power divider having a power input strip and two power output strips, and a resistive material layer interposed between the metal layer and the substrate. The resistive material layer includes a resistive bridge that extends out from under the metal layer and conductively interconnects the two power output strips so as to provide a resistive load for the cancellation of reflected power output signals.

An advantage of the present invention is that the resistive load is formed integrally with the power divider through the use of well-known photolithographic techniques and materials. This allows a resistive load having a desired resistive value to be accurately placed between the power output strips and, thereby, produce a device having a particular center operating frequency. It also allows the power division ratio and the resistive load value to be changed after the initial fabrication of the device.

Another advantage of the present invention is that it permits the simultaneous formation of identical power dividers on both sides of a flat substrate to form a single, highly efficient airstripline power divider.

These and other attendant advantages of the present invention will become apparent and readily appreciated as the same becomes better understood by reference to the following detailed description when considered in connection with the accompanying drawings.

DETAILED DESCRIPTION OF THE INVENTION

The present invention provides stripline-type power dividers/combiners having integral resistive loads which are formed concurrently therewith. As previously explained, the power divider structure is generic to both power dividers and combiners, the only difference being the manner of its use. Thus, in the following discussion, the power divider/combiner structure will be described only in terms of its operation as a power divider.

Figure 1:
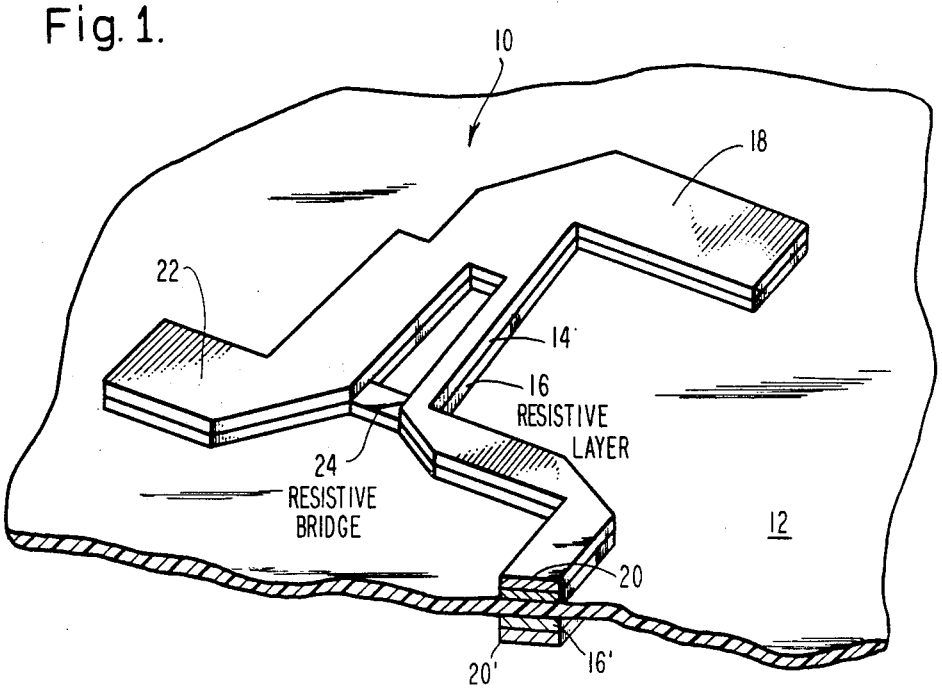
FIG. 1 is a perspective view of an airstripline-type power divider according to the present invention.

In FIG. 1 there is shown a perspective view of a stripline-type power divider constructed according to the present invention. The divider 10 is comprised of a patterned, highly conductive metal layer 14 having one input strip 18 and two output strips 20, 22, a dielectric substrate 12, and a resistive material layer 16 interposed between the metal layer 14 and the substrate 12. While the resistive material layer 16 is largely delimited by the boundaries of the metal layer 14, it includes a resistive bridge 24 which extends out from under the metal layer 14 and conductively interconnects the portions of the resistive material layer 16 underlying the two power output strips 20, 22. The bridge 24, acting as the resistive load for the power divider 10, is appropriately located at a distance of an odd multiple of $\lambda/4$ from the junction of the input strip 18 and the output strips 20, 22, where the desired center operating frequency of the power divider 10 is proportional to $1/\lambda$.

The preferred embodiment of the present invention utilizes the above described power divider structure in an airstripline configuration. That is, a mirror image, but otherwise identical, power divider structure is placed on a parallel opposing major surface of the substrate 12 and positioned so that the two structures have a topological one-to-one correspondence. This is indicated in FIG. 1 by the presence of an aligned output strip 20' and relatively underlying portion of a resistive layer 16'. The ends of the respective input and output strips are conductively connected (not shown) to permit the power dividers to effectively operate in parallel.

Figure 3:
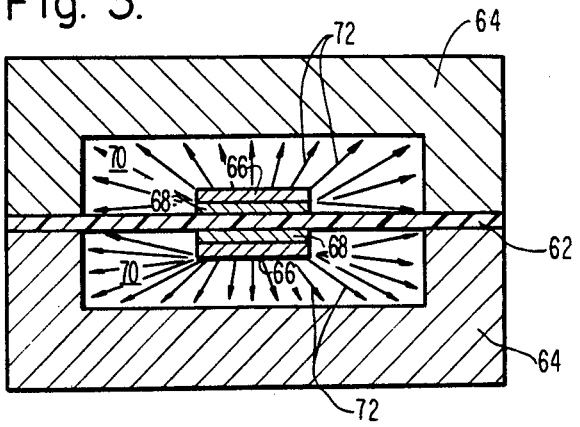
FIG. 3 is a cross-sectional view of a single strip of the preferred airstripline embodiment of the present invention.

A representative cross-section of a single strip of an airstripline power divider constructed according to the present invention is shown in FIG. 3. Metal layers 66 and resistive material layers 68, which are mirror images of one another, are positioned in topological one-to-one correspondence on the parallel opposing surfaces of a substrate 62. The power divider is supported within an air dielectric 70 by a surrounding ground plane fixture 64.

The principal advantage in using the airstripline configuration, and the principal reason for adapting it for use in the preferred embodiment, stems from its tolerance of non-uniform dielectric and lossy substrates. Since the TEM mode waves propagating along each of the metal layer 66 are essentially identical, in terms of potential and phase, very little of the electric field associated with the propagating waves, indicated by the rays 72, penetrates the substrate. Therefore, the power loss in an airstripline power divider is substantially independent of the dielectric value of the substrate. Likewise, in the preferred embodiment, very little of the electric field 72 penetrates the lossy resistive material layers 68. Consequently, there is practically no degradation of the efficiency of the airstripline power divider due to the presence of the resistive material layers 68.

The preferred embodiment of the invention can be fabricated from a prepared substrate using standard photolithographic and etching techniques and materials. The prepared substrate is a construct of a polymide substrate, preferably of triazine having a thickness of approximately 15 mils, covered on both sides first with a resistive material layer, preferably of Nichrome having a thickness of four micrometers or less and a resistance of approximately 100 ohms per square, and then with a highly conductive metal layer, preferably of copper having a thickness of approximately 17 micrometers. This substrate construct is available from the Mica Corporation, 10900 Washington Blvd., Culver City, Calif. 90230. Photoresist masks of the desired power divider pattern and integral resistor are then formed on the surfaces of the metal layers. This is followed by successive etchings with ferrite chloride and copper sulfate pentahydrate-sulfuric acid solutions to remove the excess portions of the metal and resistive material layers. The power divider is remasked with photoresist to define the resistive bridge and then etched with a chromium trioxide and sulfuric acid solution. This etching selectively removes the metal layer without significantly affecting the resistance value of the resistive bridge. Naturally, the etching process can be repeated to adjust the power division ratio of the divider and the resistance value of the resistive bridge.

Figure 2:
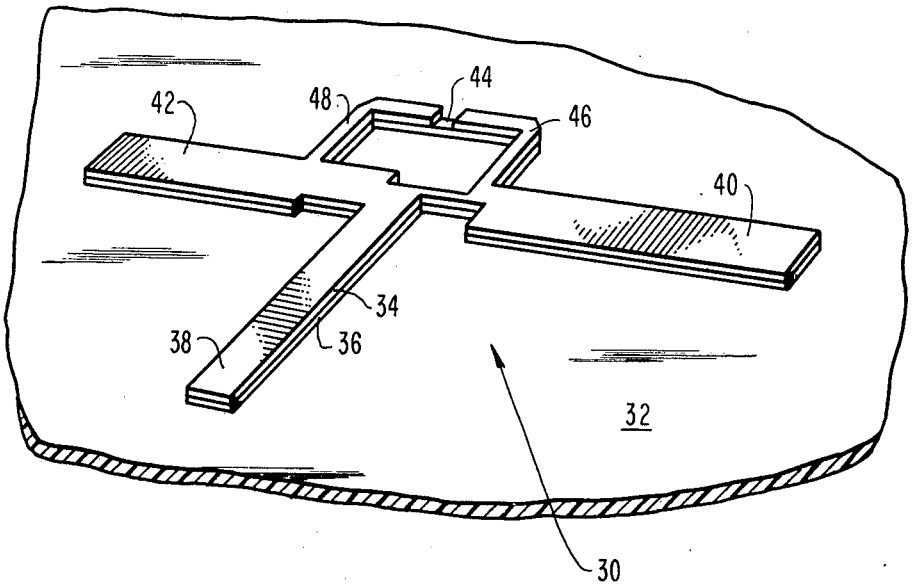
FIG. 2 is a perspective view of a stripline-type power divider of a design different from that of FIG. 1, but which also embodies the present invention.

The use of the present invention does not limit, in any way, the design of stripline-type power dividers constructed in accordance with the present invention. The particular dimensions of the patterned metal layer and the selection of the value of the resistive load supplied by the resistive bridge may be determined by resort to the well-known equations describing the propagation of TEM mode waves. As an example, an alternate embodiment of the present invention is shown in FIG. 2. The power divider 30 is comprised of a highly conductive, patterned metal layer 34 having one input strip 38 and two output strips 40, 42, a dielectric substrate 32, and a resistive material layer 36 interposed between and adjacent to the metal layer 34 and the substrate 32.

The power divider structure of FIG. 2 differs from that of FIG. 1 in that it includes a pair of extensions 46, 48 of the output strips 40, 42. In providing a conductive connection between the output strips and the resistive bridge 44, these extensions effectively place the resistive bridge at a distance of an odd multiple of $\lambda/4$ from the junction of the input strip and output strips, as measured along either extension and its respective output strip.

The power divider design shown in FIG. 2, similarly to the power divider design of FIG. 1, may be used effectively in either a single-sided stripline configuration or in the preferred, double-sided airstripline configuration.

Thus, a generalized, high frequency power divider/combiner having an integral resistor has been described. Obviously, many modifications and variations are possible in light of the above teachings, such including substituting functionally equivalent materials for the metal and resistive material layers and the substrate and by varying the pattern of the metal layer. It is therefore to be understood that, within the scope of the appended claims wherein the structure is generally referred to as a power divider, the present invention may be practiced otherwise than as specifically described.

What is claimed is:

1. A high frequency airstripline power divider having a center operating frequency proportional to $1/\lambda$, and including:

(a) a substrate having two major surfaces and topographically corresponding metal layers having a single power input strip joined to a pair of power output strips overlying each of said major surfaces; and (b) a resistive material layer interposed between each said metal layer and its respective major surface of said substrate, a portion of each said resistive material layer defining a bridge resistively interconnecting said pair of power output strips.

2. The device of claim 1 wherein each said bridge is conductively interconnected between the respective portions of said resistive material layer underlying said pair of power output strips at points an odd multiple of $\lambda/4$ from the junction of said power input strip and said pair of power output strips.

3. The device of claim 1 wherein each of said metal layers includes a pair of conductive strips overlying portions of said resistive material layer, each conductively connected between a respective one of said pair of power output strips and said resistive material bridge, said conductive strips being connected to said pair of power output strips at points an odd multiple of $\lambda/4$ from the junction of said power input strip and said power output strips, and having a length of an even multiple of $\lambda/4$.

4. The device of claim 2 or 3 wherein each said resistive material layer, exclusive of said resistive material bridge, is substantially delimited by its respective one of said metal layers.

5. A high frequency airstripline power divider having a center operating frequency proportional to $1/\lambda$ comprising:

(a) a substrate having two major parallel surfaces;

(b) a conductive metal layer overlying each of said substrate major surfaces, said metal layers configured as topographically corresponding high frequency power dividers having a power input conductor strip and a pair of power output conductor strips connected to said input conductor strip at a common junction point; and (c) a resistive material layer interposed between each of said conductive metal layers and said major substrate surfaces, each said resistive material layer being substantially delimited by its respective said conductive metal layer and including a bridge of said resistive material extending between the resistive material underlying its respective said output conductor strips at points an odd multiple of $\lambda/4$ from said common junction point, so as to resistively interconnect said power output strips.

6. A high frequency power divider comprising:

(a) a dielectric substrate;

(b) a first resistive material layer adjacent a first major surface of said substrate; and (c) a first metal layer adjacent said first resistive material layer, said first metal layer patterned so as to have a first power input strip commonly connected to a pair of first power output strips, said first resistive material layer being correspondingly patterned and uniformly underlying said first patterned metal layer, said resistive material layer including a first resistive material bridge extending between those portions of said first resistive material layer respectively underlying said output strips.

7. The device of claim 6 wherein said substrate has a second major surface substantially parallel opposing the first major surface, said device further comprising:

(a) a second resistive material layer adjacent the second major surface of said substrate; and (b) a second metal layer adjacent said second resistive material layer, said second metal layer and said second resistive material layer being respectively patterned so as to have one-to-one topological correspondence with said first metal layer and said first resistive material layer, respectively, the corresponding ends of said power input strips and said power output strips of said first and said second metal layers being conductively interconnected such that said power dividers operate in parallel.

8. The device of claim 6 or 7 wherein said first resistive material bridge is located at a distance of an odd multiple of $\lambda/4$ from the common interconnection point of said first power input strip and said first power output strips, where $\lambda$ is the center operating wavelength of said power divider.

9. The device of claim 8 wherein said first resistive material layer is Nichrome.

10. The device of claim 9 wherein said first metal layer is copper.

11. A method of fabricating a high frequency stripline power divider from a substrate construct including a dielectric substrate, a resistive material layer provided adjacent a surface of said substrate, and a metal layer provided adjacent said resistive material layer, said method comprising the steps of:

(a) removing a portion of said metal layer and a corresponding portion of said resistive material layer so as to leave a power input strip, a pair of power output strips, and a bridge strip extending between said power output strips; and (b) removing a portion of said metal layer of said bridge strip so as to expose the underlying portion of said resistive material layer, thereby leaving a resistive bridge interconnecting said power output strips.

* * * * *